US012798851B2

(12) United States Patent
Han et al.

(10) Patent No.: US 12,798,851 B2
(45) Date of Patent: Nov. 17, 2026

(54) ULTRAVIOLET-CURABLE NAIL GEL PACKAGING POUCH AND METHOD OF MANUFACTURING THE SAME

(71) Applicants: Jeong Sik Han, Gyenoggi-do (KR); Gyoung Hee Kim, Gyeonggi-do (KR)

(72) Inventors: Jeong Sik Han, Gyenoggi-do (KR); Gyoung Hee Kim, Gyeonggi-do (KR)

( * ) Notice: Subject to any disclaimer, the term of this patent is extended or adjusted under 35 U.S.C. 154(b) by 102 days.

(21) Appl. No.: 18/957,890

(22) Filed: Nov. 25, 2024

(65) Prior Publication Data

US 2025/0120495 A1 Apr. 17, 2025

Related U.S. Application Data

(63) Continuation of application No. PCT/KR2024/015133, filed on Oct. 4, 2024.

(30) Foreign Application Priority Data

Oct. 17, 2023 (KR) ..... 10-2023 0138281
Sep. 30, 2024 (KR) ..... 10-2024-0132631

(51) Int. Cl.
*B65D 75/52* (2006.01)
*A45D 34/04* (2006.01)
(Continued)

(52) U.S. Cl.
CPC ..... *B65D 75/522* (2013.01); *A45D 34/045* (2013.01); *B65B 3/02* (2013.01);
(Continued)

(58) Field of Classification Search
CPC ..... B65D 75/522; B65D 75/5833; B65D 2575/586; A45D 34/045; B65B 3/04; B65B 61/186
(Continued)

(56) References Cited

U.S. PATENT DOCUMENTS 6,036,679 A * 3/2000 Balzar ..... A61F 13/5514 206/440
6,062,381 A * 5/2000 Paley ..... A47K 10/32 206/812
6,068,820 A * 5/2000 De Guzman ..... B65D 81/3272 206/229
(Continued)

FOREIGN PATENT DOCUMENTS

KR 20-0475031 Y1 11/2014
KR 10-2017-0050892 A1 5/2017

*Primary Examiner* — Peter N Helvey
(74) *Attorney, Agent, or Firm* — Nicholas Park

(57) ABSTRACT

An ultraviolet-curable nail gel packaging pouch includes a body portion filled with an ultraviolet-curable nail gel and configured to discharge the nail gel therefrom or to be inserted with a brush, wherein the body portion is configured to prevent ultraviolet light from passing through; a transparent window portion filled with the nail gel as that of the body portion to allow the nail gel having the color as that of the body portion to be visible from outside; and a border line formed between the body portion and the transparent window portion by joining two pieces of pouch sheets disposed at front and rear sides to prevent the nail gel filled in the body portion and the transparent window portion from mixing with each other, thereby allowing the color of the nail gel to be identifiable from the outside without a separate color indicia, reducing related works and manufacturing costs.

14 Claims, 15 Drawing Sheets

(51) Int. Cl.
*B65B 3/02* (2006.01)
*B65B 3/04* (2006.01)
*B65B 61/18* (2006.01)
*B65D 75/58* (2006.01)

(52) U.S. Cl.
CPC ..... *B65B 3/04* (2013.01); *B65B 61/186* (2013.01); *B65D 75/5883* (2013.01); *B65D 2575/586* (2013.01)

(58) Field of Classification Search
USPC ..... 383/38
See application file for complete search history.

(56) References Cited

U.S. PATENT DOCUMENTS

RE41,273 E * 4/2010 Perell ..... B65D 75/5855 383/61.1
7,757,893 B2 * 7/2010 Perell ..... B65D 75/48 222/541.9
7,909,165 B2 * 3/2011 Perell ..... B65D 75/323 206/532
8,328,017 B2 * 12/2012 Perell ..... B65D 75/305 383/3
8,528,739 B2 9/2013 Haile
8,684,601 B2 * 4/2014 Perell ..... B65D 75/5855 383/906
9,414,974 B2 * 8/2016 Bennett ..... B65D 83/0805
D783,415 S * 4/2017 Tran ..... D9/707
11,724,866 B2 * 8/2023 Perell ..... B65D 75/527 383/210
12,605,017 B2 * 4/2026 Teufel ..... A47K 10/421
2007/0080078 A1 * 4/2007 Hansen ..... B65D 81/3266 206/219
2014/0004227 A1 * 1/2014 Tran ..... A45D 37/00 426/112

* cited by examiner

ULTRAVIOLET-CURABLE NAIL GEL PACKAGING POUCH AND METHOD OF MANUFACTURING THE SAME

CROSS-REFERENCE TO RELATED APPLICATION

This application is a U.S. Bypass Continuation Application of International Application No. PCT/KR2024/015133, filed Oct. 4, 2024, which claims priority to and the benefit of Korean Patent Application No. 10-2023-0138281, filed on Oct. 17, 2023, and Korean Patent Application No. 10-2024-0132631, filed on Sep. 30, 2024, the entire contents of which is incorporated herein for all purposes by this reference.

BACKGROUND

Field of the Disclosure

The present disclosure relates to an ultraviolet-curable nail gel packaging pouch, and more specifically, to an ultraviolet-curable nail gel packaging pouch that prevents a nail gel charged inside the pouch from being deteriorated by ultraviolet light and allows a true color of the charged nail gel to be identifiable from the outside.

Description of Related Art

This section only provides background information related to contents of this application and does not necessarily constitute prior arts to the present disclosure.

In general, a nail gel used for a nail (toenail) beautification should be hardened within a short time after being applied to the nail, so that the applied nail gel does not get on the surroundings. For this purpose, an ultraviolet-curable (or an ultraviolet curing type) gel has been widely used. The nail gel applied to the nail becomes cured by exposing under an ultraviolet lamp between a few seconds and 1~2 minutes depending on conditions such as a distance and an angle from a light source or an application thickness of the nail gel.

Therefore, a nail gel container containing the ultraviolet-curable nail gel may be manufactured with an opaque material that prevents penetration of ultraviolet light, so that the nail gel may not be deteriorated according to surrounding environments. In other words, in a case that the nail gel container is transparent, even if an ultraviolet lamp is not directly illuminated to the container, ultraviolet light from a fluorescent lamp in the room or sunlight may harden the nail gel filled in the container. Accordingly, the nail gel may be hardened in its distribution process or during storage by the user even before its use and become useless in the end. Hence, it is required to make the nail gel container as an opaque container to prohibit the ultraviolet light's penetration, so it is impossible to identify the contents inside the nail gel container.

Until now, the nail gel has been manufactured as an ultraviolet-curable type, and the nail gel has been charged in an opaque glass bottle that may block light including the ultraviolet light from passing through. Then, the color of the content (e.g., nail gel) is indicated on the outside of the container in several identifiable ways to allow the consumer to identify the color of the nail gel which he or she wants to choose. For example, the outside of the container is color-coated with the same color as the content, or a color printed sticker is attached on the outside of the container. Otherwise, an injection-molded plastic cap having the same color is used to indicate the color of the content.

Meanwhile, the nail gel has been used for nail beauty to decorate user's nails colorfully, which is manufactured and sold in hundreds or thousands of different colors depending on the manufacturer. Here, to indicate each color of the contents separately on the outside of the container it requires a huge amount of related works and a large inventory, which needs a lot of money and increases manufacturing costs.

Since the nail gel used for nail beauty is designed to be quickly hardened by illuminating the ultraviolet light on the nail gel applied on the user's nail, the container charged with the nail gel is required to maintain marketability by preventing the content from hardening when the ultraviolet light penetrates into the container except when the nail gel is being used. For this purpose, the nail gel container in the prior art uses an opaque glass container that does not transmit light or a solvent-resistant opaque plastic container. Such containers are made of opaque materials so that the contents inside the bottle may not be visible from the outside of the container. In other words, even though the color of the content is very important to nail gel consumers, they may not identify the color of the content inside the container from the outside. Accordingly, as an alternative, manufacturers of the nail gel container separately prepare a sticker having a color close to that of the content and attach them to the outside of the container. Furthermore, when using the solvent-resistant opaque plastic container, the container itself may be injection molded in a similar color as the content, or an epoxy sticker with the similar color may be attached to the outer surface of the container.

The nail gel for nail beauty has been manufactured in a variety of colors to satisfy consumers' desire or preference to decorate their nails colorfully. When opaque containers are used for packaging the nail gel, each color of the nail gel should be displayed separately on the outside of the container, which needs a variety of miscellaneous works and large amount of costs. In addition, it is not easy to exactly match the color of the printed matter being attached outside of the container with the color of the content.

Although the ultraviolet-curable nail gel has the above-mentioned disadvantages, the reasons why thermosetting gels or natural drying gels have not been made and used are as follows.

After applying the nail gel of the desired color on the nails, it needs to make sure that the applied nail gel hardens quickly and does not stick around. A thermosetting nail gel may not be used because when applying heat to the nail to harden the nail gel, the user's hands become hot, too. Meanwhile, a natural drying-type nail gel may not be used in practice because the user has to wait long until the applied nail is dried and cured, and further the nail gel may stain the surroundings before a curing operation is completed. In contrast, the ultraviolet-curable nail gel may be hardened immediately after being applied and illuminated with an ultraviolet lamp, thereby maximizing convenience of use by quickly completing the nail gel application process.

To display the color of the content separately on the outside of the container, it requires a variety of works and a large amount of inventory, thereby incurring a large amount of manufacturing costs. For example, when printing a color sticker having one color to be attached onto the surface of the container, a basic order quantity for one time printing works of the color sticker is about 8 km in length. If one hundred (100) colors are needed, approximately 800 km of color stickers should be printed, which remains as a huge amount of inventory because not all stickers are shipped and distributed at once. Furthermore, for opaque containers made by a plastic injection molding there exists a basic quantity of containers having one type of color to be injected. Supposing that containers having 100 types of colors are to be injection molded, huge amounts of containers with different colors have to be manufactured by the injection molding, and enormous costs and times are required for maintenance of the container inventory.

Korea Registered Utility Model No. 20-0475031 discloses a container for nail polish having a container body being charged with a nail polish solution inside and a cap closing an inlet of the container body, which comprises: a glitter sheet formed with an adhesive layer at its rear surface to be attached to the container body or an outer surface of the cap; a plurality of first decorative members including a nail polish sample member having a sample coating layer formed at one side of the surface of the glitter sheet by applying the same nail polish solution as the nail polish solution in the container body and a transparent coating layer applied on the sample coating layer and cured to protect a surface of the sample coating layer, wherein the plurality of decorative members are adhesively fixed to the surface of the glitter sheet; a second decorative members having a larger external shape than the first decorative member for indicating a sample of the nail polish solution attached between the first decorative members. This Utility Model relates to a nail polish container with a nail polish sample displaying function wherein the nail polish sample member is formed on the surface of the second decoration member. However, the sample coating layer does not show the nail polish solution charged in the container body as it is.

Korea Patent Laid-Open Publication No. 10-2017-0050892 discloses a container for a gel-type liquid material comprises: a container portion having an inlet formed at a top portion and a storage space formed inside thereof for storing a liquid material for a gel nail; and a lid portion made of a transparent material and provided with a support rod having a brush at a lower portion wherein a color coating layer with a color corresponding to that of the liquid material which is identifiable from the outside is formed at least at a portion of the inner peripheral surface of the lid portion. This Utility Model relates to a gel-type liquid material storage container where the entire container is made of an opaque material or an opaque blocking layer is formed on an outer or inner peripheral surface thereof to prevent the liquid material stored inside the container from being exposed to external ultraviolet light. It is possible to identify the nail gel from the outside through the color coating layer that matches the color of the nail gel, but the color of the coating layer may be different from that of the nail gel filled inside the container and manufacturing costs are high in view of the overall configurations of the container.

The information included in this Background of the present disclosure is only for enhancement of understanding of the general background of the present disclosure and may not be taken as an acknowledgement or any form of suggestion that this information forms the prior art already known to a person skilled in the art.

SUMMARY

Various aspects of the present disclosure are directed to providing an ultraviolet-curable nail gel packaging pouch that even though ultraviolet-curable nail gels of various colors are injected and packaged in a single packaging pouch, the color of the charged nail gel may be identifiable from the outside without a separate color indicia, thereby eliminating various related works and costs generated during the manufacturing process, remarkably reducing manufacturing costs, and increasing product competitiveness.

To accomplish the above-mentioned objects, according to an exemplary embodiment of the present disclosure, there is provided an ultraviolet-curable nail gel packaging pouch including a body portion configured to prevent ultraviolet light from passing through and charged with an ultraviolet-curable nail gel, wherein the nail gel is discharged therefrom or a brush is inserted therein; a transparent window portion filled with the same nail gel as that of the body portion and configured to allow the same nail as that of the body portion to be visible from an outside; and a border line formed between the body portion and the transparent window portion by joining opposite sides of the pouch and configured to prevent the nail gel charged in the body portion and the transparent window portion from mixing with each other.

The ultraviolet-curable nail gel packaging pouch may be constituted by overlapping two pieces of pouch sheets and joining circumference portions thereof. The border line is formed between the body portion and the transparent window portion after injecting the nail gel between two pieces of pouch sheets, or the border line is formed between the body portion and the transparent window portion in advance and then the nail gel is injected into the body portion and the transparent window portion, respectively.

According to the ultraviolet-curable nail gel packaging pouch according to an exemplary embodiment of the present disclosure, a nail gel container may be made in the form of a pouch. The nail gel container may be packaged by dividing an opaque portion, i.e., a body portion which is not completely affected by ultraviolet light and a transparent window portion which is affected by ultraviolet light but the color of the content may be identifiable with a naked eye. Therefore, by forming a discharging portion (spout, etc.) in the body portion that is not affected by ultraviolet light, it is possible to use a high-quality nail gel that has not been hardened or cured by the ultraviolet light through the spout. Furthermore, a user may easily and directly identify an true color of the nail gel in the nail gel container with their eyes through the transparent window portion, thereby improving reliability of the nail gel pouch product.

Meantime, the nail gel filled inside the transparent window portion may be hardened by ultraviolet light, which in fact shows the nail gel in a hardened state to the user. In other words, such the hardened nail gel may notify the user of its real state that the nail gel has been cured after being applied to the nail, which may resolve misunderstanding of the user that the color of the nail gel may differ from the color after use. Here, the nail gel inside the transparent window portion may be some or less hardened under the influence of ultraviolet light. However, since such the nail gel stored inside the transparent window portion is not used for nail beauty and never mix with the nail gel contained in the body portion, it has nothing to do with the physical properties of the nail gel in the body portion.

Additionally, since all of the activities in the conventional manufacturing process of the container to separately display the color of the content (nail gel) on the outside of the opaque nail gel container are no longer needed, huge cost saving effects are expected.

Furthermore, the present disclosure has the effect of resolving the problems that the color of the printed material separately attached to the outside of the container or the color of the plastic container does not exactly match the color of the content charged inside the pouch.

The methods and apparatuses of the present disclosure have other features and advantages which will be apparent from or are set forth in more detail in the accompanying drawings, which are incorporated herein, and the following Detailed Description, which together serve to explain certain principles of the present disclosure.

Figure 1:
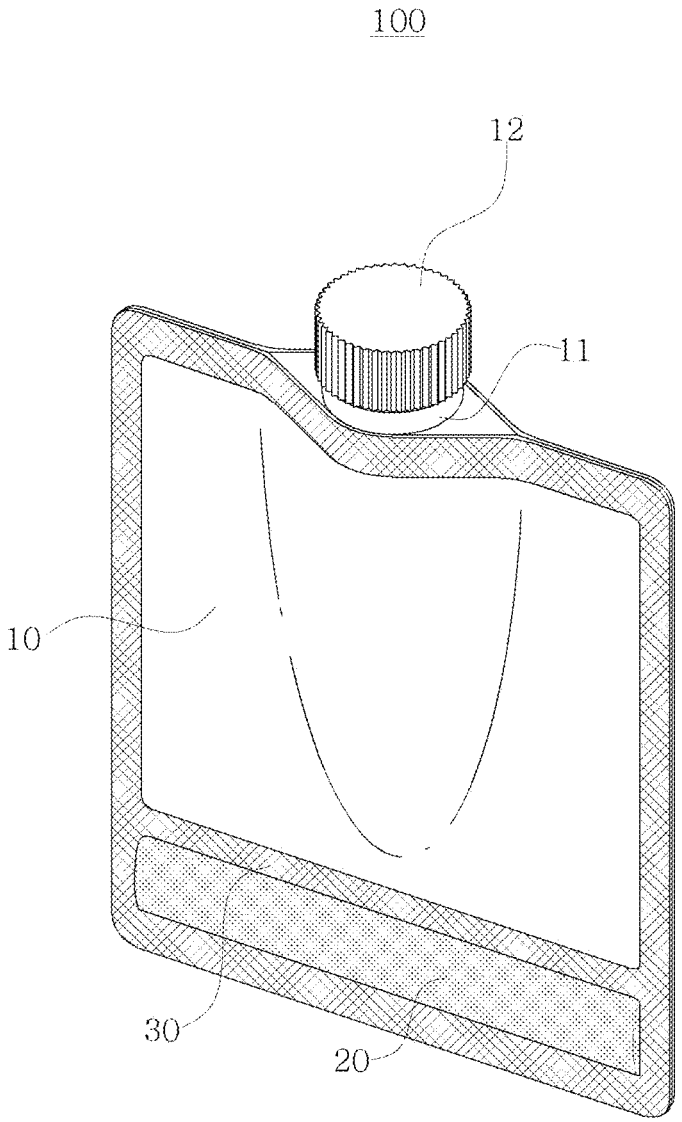
FIG. 1 is a perspective view illustrating an ultraviolet-curable nail gel packaging pouch according to an exemplary embodiment of the present disclosure.

It may be understood that the appended drawings are not necessarily to scale, presenting a somewhat simplified representation of various features illustrative of the basic principles of the present disclosure. The specific design features of the present disclosure as included herein, including, for example, specific dimensions, orientations, locations, and shapes will be determined in part by the particularly intended application and use environment.

In the figures, reference numbers refer to the same or equivalent parts of the present disclosure throughout the several figures of the drawing.

DETAILED DESCRIPTION

Reference will now be made in detail to various embodiments of the present disclosure(s), examples of which are illustrated in the accompanying drawings and described below. While the present disclosure(s) will be described in conjunction with exemplary embodiments of the present disclosure, it will be understood that the present description is not intended to limit the present disclosure(s) to those exemplary embodiments of the present disclosure. On the other hand, the present disclosure(s) is/are intended to cover not only the exemplary embodiments of the present disclosure, but also various alternatives, modifications, equivalents and other embodiments, which may be included within the spirit and scope of the present disclosure as defined by the appended claims.

In describing the exemplary embodiments of the present disclosure, if detailed descriptions of related known functions or configurations are determined to unnecessarily obscure the gist of the present disclosure, the detailed descriptions thereof will be omitted. The terms described below are defined in consideration of the functions in the present disclosure, and may vary depending on the intention of the user or the custom. Therefore, the definition of the terms should be made based on the contents throughout the specification of the present disclosure.

Figure 2:
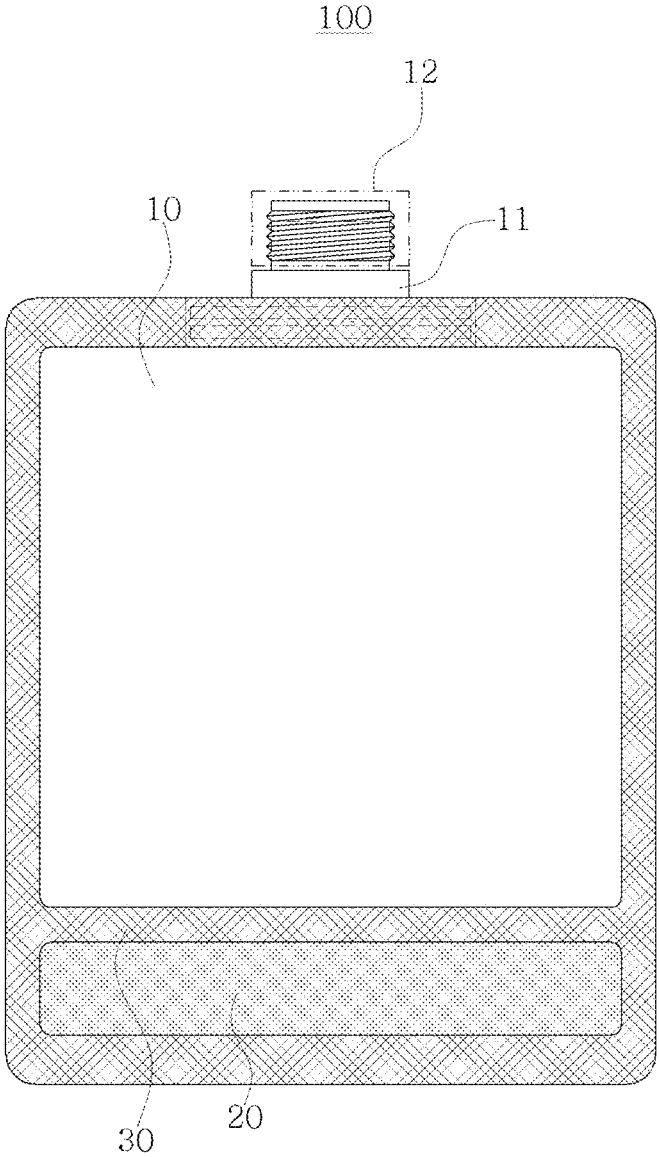
FIG. 2 is a front view illustrating an ultraviolet-curable nail gel packaging pouch according to an exemplary embodiment of the present disclosure.

As shown in FIGS. 1 and 2, an ultraviolet-curable nail gel packaging pouch 100 (hereinafter referred to as "pouch") according to an exemplary embodiment of the present disclosure may include a body portion 10, a transparent window portion 20, and a border line 30 that is formed by thermal bonding (heat sealing) between the body portion 10 and the transparent window portion 20, wherein the body portion 10 and the transparent window portion 20 contain the same contents (nail gel) and do not mix with each other.

Various exemplary embodiments of the present disclosure will be described hereinafter. The following embodiments may have common features that the same contents may be charged in the body portion 10 through which ultraviolet light may not penetrate and the transparent window portion 20 through which the contents may be identifiable from the outside, but the body portion 10 and the transparent window portion 20 may be divided from each other by the border line 30, so the contents of the body portion 10 and the transparent window portion 20 may be separated and may not mix with each other.

The body portion 10 may be made of an opaque pouch sheet and the transparent window portion 20 may be made of a transparent sheet.

First Embodiment

Referring to FIGS. 1 and 2, the body portion 10 may include a spout 11 and a cap 12 to use the content (nail gel)

charged therein, and the nail gel may be squeezed through the spout 11 or may be applied onto a user's nail with a brush (not shown).

A pouch sheet constituting the body portion may be, as an example, a lamination of a thin aluminum foil and a polyethylene terephthalate (PET) film, which may completely prohibit penetration of ultraviolet light therethrough.

In contrast, the transparent window portion 20 may be made of only a transparent sheet (for example, a PET film), so that a color of the content may be directly identifiable from the outside.

The PET film, a transparent sheet, may be a material with characteristics including a low heat shrinkage rate under high temperature and high humidity conditions, and it may have a low shrinkage and deformation features during a manufacturing process like a lamination coating and a printing.

The transparent window portion 20 may be separated from the body portion 10 by a border line 30 to prevent the mixing of nail gels. The transparent window portion 20 may be formed at any position of the body portion 10, preferably adjacent to the inner side of a circumference portion (end) of the pouch. Additionally, the transparent window portion 20 may be formed horizontally along the left and right directions at the bottom of the body portion 10, or lengthwise in the vertical direction along the side of the body portion 10, with the border line 30 being formed according to the positioning of the body portion 10 and the transparent window portion 20.

The spout 11 may be heat-sealed to an upper side of the body portion 10, and a diameter of an inlet of the spout 11 may be large enough to accommodate a brush (not shown), so the nail gel may be withdrawn by putting the brush into the body portion 10 and applying the nail gel onto a user's nail.

Second Embodiment

Figure 3:
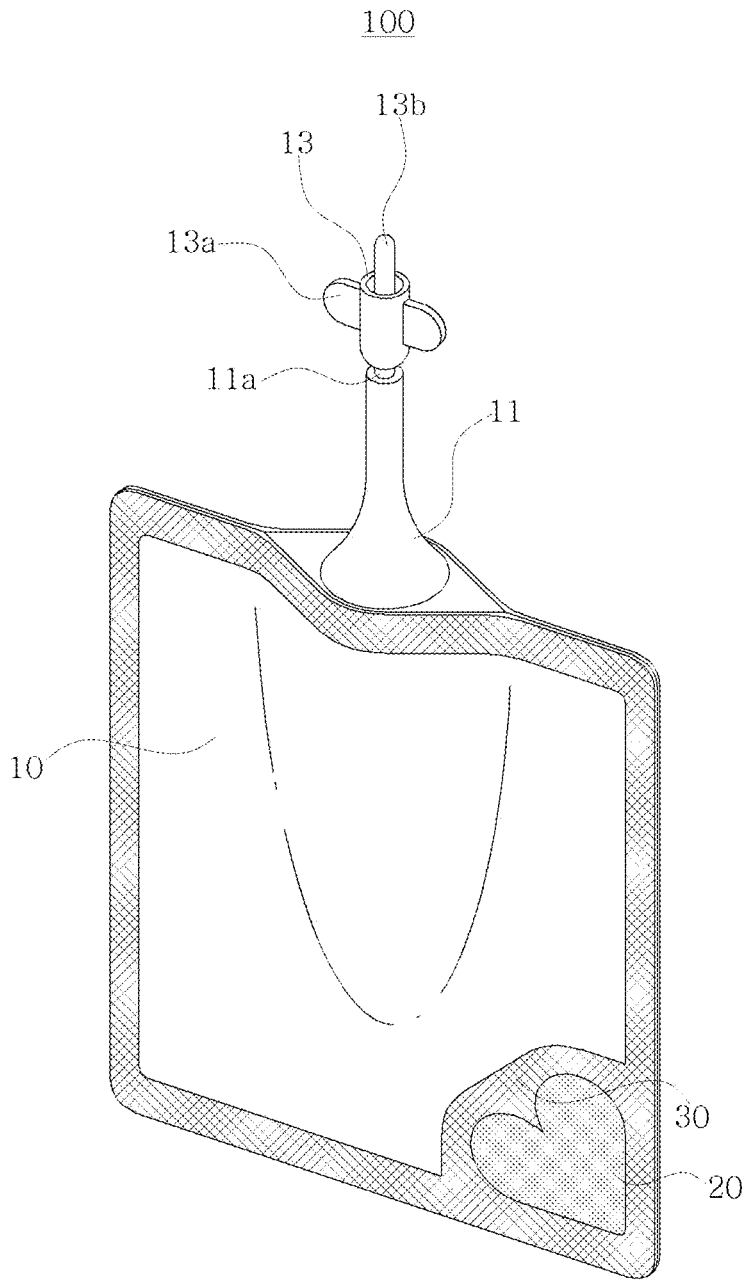
FIG. 3 is a perspective view illustrating an ultraviolet-curable nail gel packaging pouch according to an exemplary embodiment of the present disclosure where a cap is integrally formed with a body portion.

As shown in FIG. 3, a pouch 100 according to an exemplary embodiment of the present disclosure may include a cap portion 13 integrally formed with a top portion of a spout 11 which is provided at an upper side of the body portion 10. At the time of a first use of the pouch 100, when holding both wings 13*a* of the cap portion 13 and then twisting the same, the cap portion 13 at an upper side may be separated at a separation groove 11*a* to form a hole (not shown) in the spout 11.

Accordingly, the nail gel filled inside the body portion 10 may be squeezed through the hole, and may be spread evenly on the user's nail with a brush (not shown), and may be finished by hardening with an ultraviolet lamp. After using the nail gel, if there remains the nail gel in the body portion 10, the separated cap 13 may be turned over and then a pin portion 13*b* formed on the top of the cap 13 may be inserted into the hole of the spout 11, which may allow the user to store the remnant nail gel inside the body portion 10 without leaking therefrom.

The pouch 100 according to exemplary embodiment of the present disclosure shown in FIG. 3 illustrates that the transparent window portion 20 is located at a lower corner portion of the body portion 10 and is separated through a border line 30.

Third Embodiment

Figure 4:
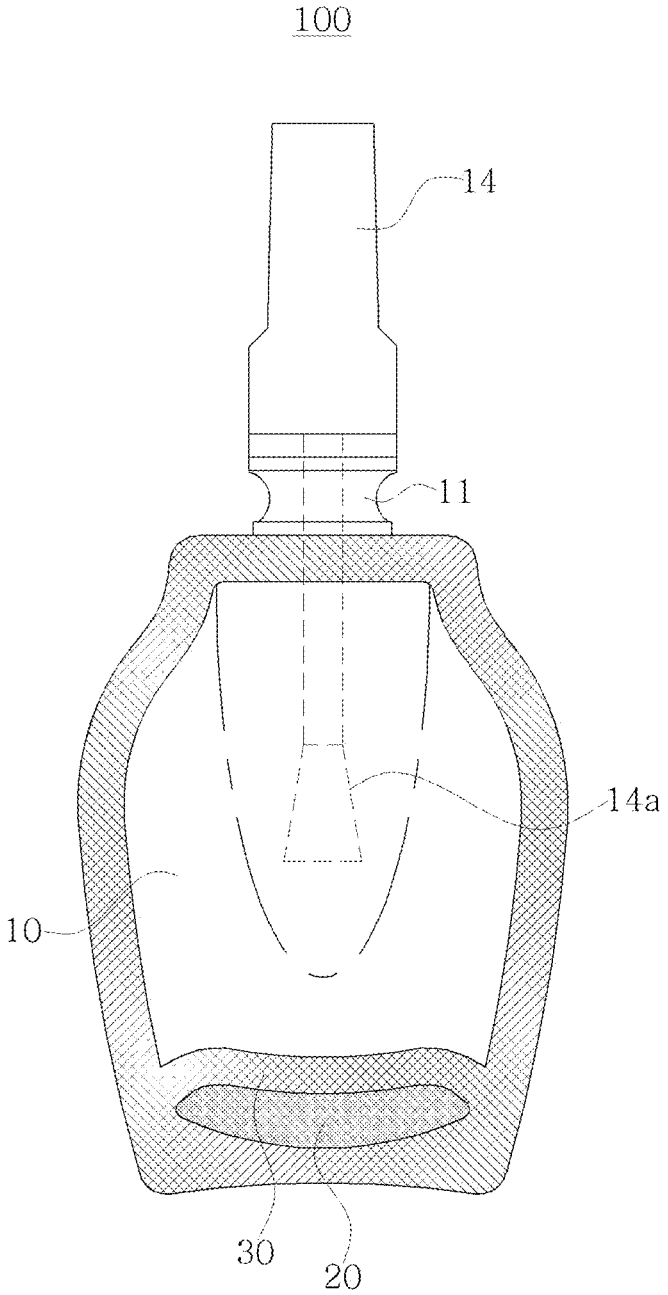
FIGS. 4 and 5 are exemplary views, respectively, illustrating an ultraviolet-curable nail gel packaging pouch according to an exemplary embodiment of the present disclosure where a brush is provided at a bottom portion of a cap connected to a body portion.
Figure 5:
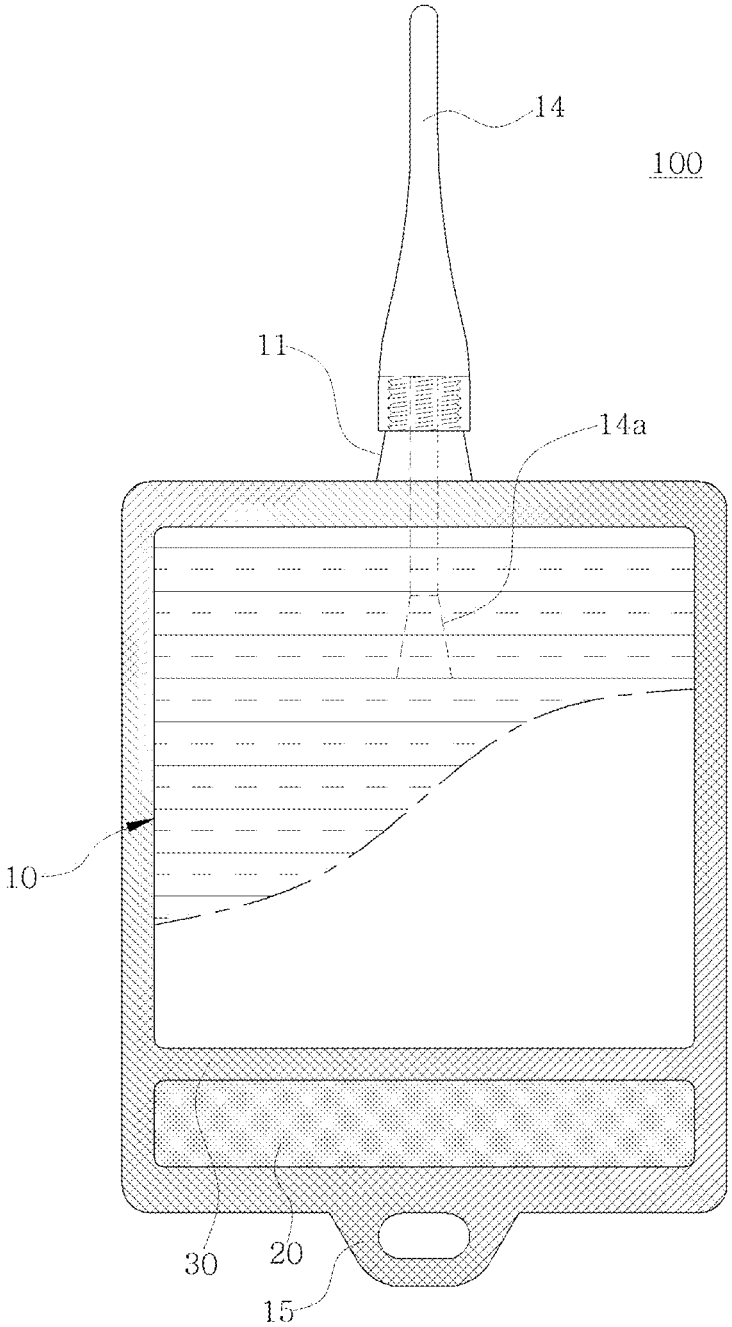

As shown in FIGS. 4 and 5, a pouch 100 according to an exemplary embodiment of the present disclosure may include a cap 14 to open or close a hole of a spout 11 and may be integrally provided with a brush 14*a*.

Since the brush 14*a* is provided at a lower end portion of the cap 14, in a state that the cap 14 is closed, the brush 14*a* may be positioned within the pouch through the hole and immersed in the nail gel filled inside the pouch 100. Accordingly, it is possible that the user applies the nail gel immediately after opening the cap 14.

In addition, a hanger portion 15 may be additionally provided at a lower portion of the pouch 100. The hanger portion 15 is configured to hang the pouch 100 for storage or display, and one or more hanger portions 15 may be formed at any of the circumference portions of the pouch 100.

Fourth Embodiment

Figure 6:
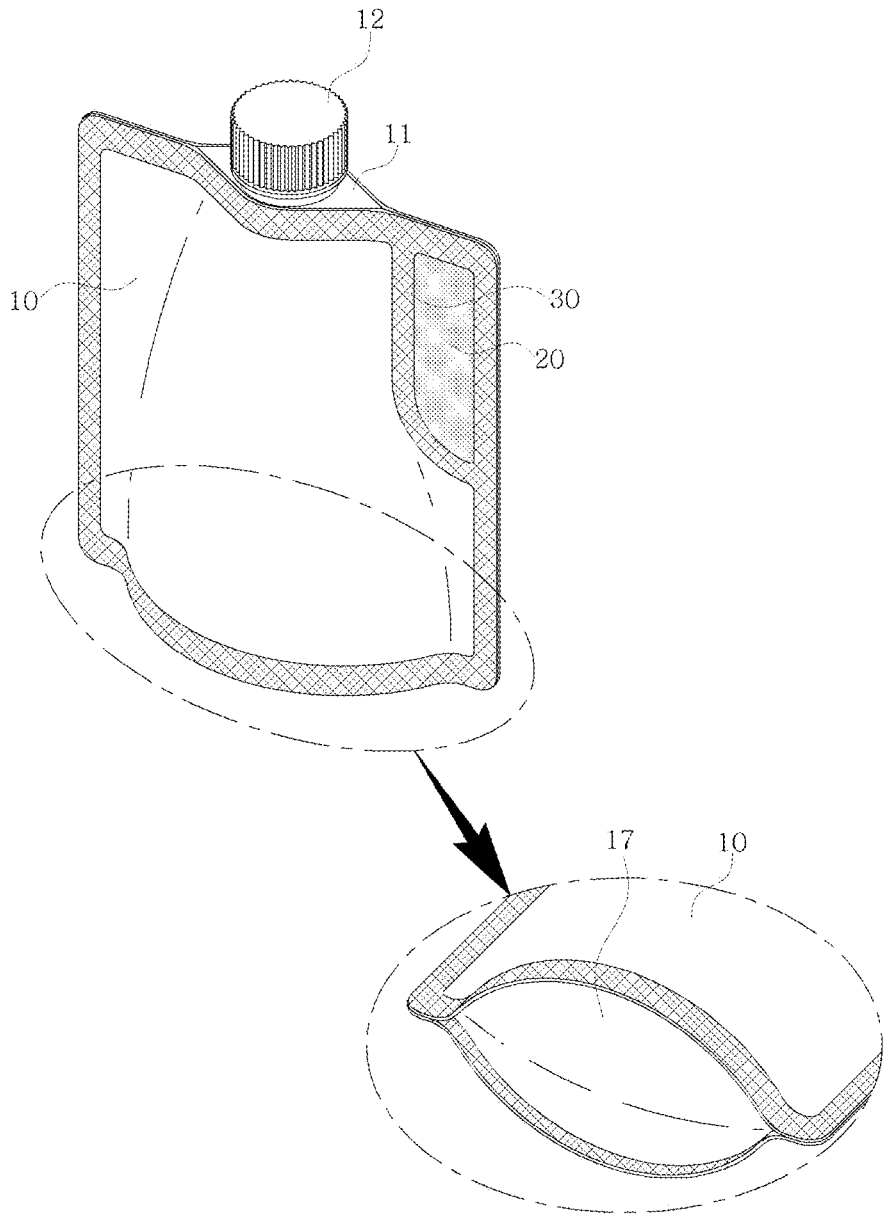
FIG. 6 is a perspective view illustrating an ultraviolet-curable nail gel packaging pouch according to an exemplary embodiment of the present disclosure where the pouch itself may be erected by forming a flat bottom surface at a lower portion, allowing more amount of nail gel to be charged in a body portion and a transparent window portion is positioned at an upper corner portion of the pouch.

As shown in FIG. 6, a pouch 100 according to an exemplary embodiment of the present disclosure may include a flat bottom surface 17 at a lower portion thereof. Accordingly, more amount of the nail gel may be charged in the body portion 10, and further the pouch 100 itself may be erected.

In this case, the transparent window portion 20 of the pouch 100 with the flat bottom surface 17, may be disposed at an upper side of the body portion 10, preferably at an upper left corner portion or at an upper right corner portion of the pouch 100.

Fifth Embodiment

Figure 7:
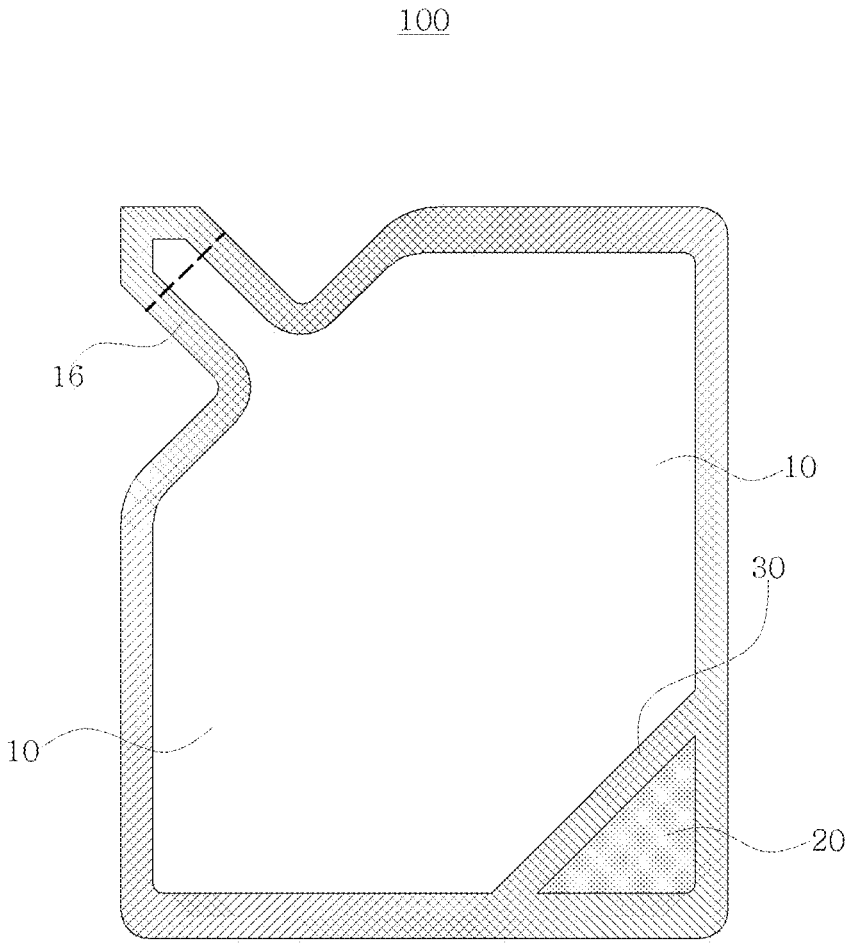
FIG. 7 is a front view illustrating an ultraviolet-curable nail gel packaging pouch according to an exemplary embodiment of the present disclosure where a spout is formed in the pouch without a separate plastic spout.

As shown in FIG. 7, a pouch 100 according to an exemplary embodiment of the present disclosure may be formed with a nozzle portion 16 without a separate plastic spout. That is, the nozzle portion 16 may be integrally formed in a protruded shape from a part of a circumference portion of the body portion 10 at one side of the body portion 10.

The nail gel in the body portion 10 may be squeezed and used by cutting an end portion (a dotted line) of the nozzle portion 16 with scissors or the like.

The pouch 100 shown in FIG. 7 may be substantially suitable for a disposable use. In a case that the nail gel remains in the body portion 10, the nozzle portion 16 may be pinched with a clip or the like to prevent the nail gel from leaking and may be stored for a future use. The transparent window portion 20 may be located at a corner portion of the pouch 100 opposite to the nozzle portion 16 and may be discrete from the body portion 10 through a border line 30.

In the present disclosure, the pouch 100 having the transparent window portion 20 may be manufactured by punching and removing a portion formed in a window shape at a predetermined position of the pouch sheet in which a thin aluminum foil and a PET film is laminated to block transmission of ultraviolet light, and then by laminating a transparent sheet onto the pouch sheet having the punched opening.

The transparent window portion 20 may have a transparent window on only one side of the pouch or on both sides of the pouch. The transparent windows formed on both sides of the pouch may match their positions to be penetratively visible from a front side of the pouch to a rear side of the pouch.

Alternatively, a transparent window portion may be formed by bonding a transparent sheet which has a larger width than that of the opaque pouch sheet and forming the transparent window portion from a portion protruding from the pouch sheet. In other words, a pouch sheet in which a thin aluminum foil and a PET film are laminated and ultraviolet light is not penetrated and a transparent sheet film with a width which is a lengthwise width of the body portion plus a width of the transparent window portion may be laminated to manufacture a pouch. Here, a width portion of the pouch sheet which does not transmit ultraviolet light may be used as a body portion, while a portion laminated with the transparent sheet film that is wider than that of the pouch sheet may be used as a transparent window portion.

The above-mentioned spout 11, the cap 12, the spout 11 integrally formed with a cap, the cap 14 with a brush, or the nozzle portion 16 may constitute examples of opening lid of the ultraviolet-curable nail gel packaging pouch according to exemplary embodiments of the present disclosure.

Hereinafter, various manufacturing processes of the ultraviolet-curable nail gel packaging pouch ("pouch") according to exemplary embodiments of the present disclosure will be described.

Figure 8:
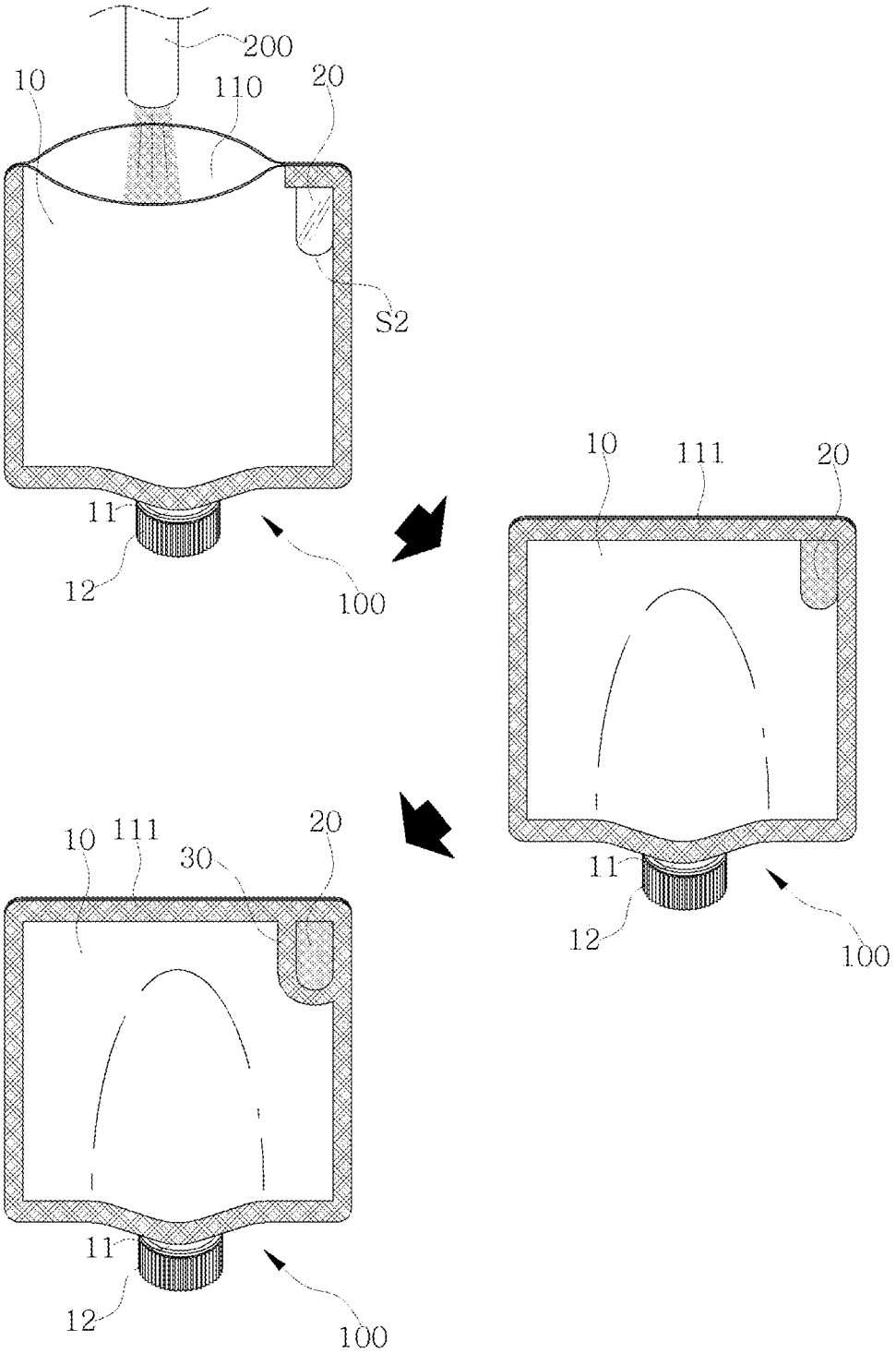
FIG. 8 is an exemplary view illustrating a method of manufacturing an ultraviolet-curable nail gel packaging pouch according to an exemplary embodiment of the present disclosure, wherein after injecting a nail gel, a body portion and a transparent window portion is divided and sealed to each other.

First Embodiment (See FIG. 8)

1. Making a Pouch With an Opening

A pouch 100 which has an opening portion 110 at one side thereof for injecting a nail gel is manufactured.

In this state, circumference portions of the pouch 100 may be bonded to form the opening portion 110 at an opposite side of a spout 11, and therefore, a body portion 10 and a transparent window portion 20 may be formed and communicated with each other.

2. Injecting a Nail Gel

An injecting port of a nozzle 200 may penetrate into a space of the body portion 10 through the opening portion 110 of the pouch 100 and a nail gel may be injected into the body portion 10 through the nozzle 200.

Since the body portion 10 and the transparent window portion 20 are formed in a single internal space that communicates with each other, the nail gel may be injected into both the body portion 10 and the transparent window portion 20 without distinction.

After completion of a nail gel injection, the opening portion 110 may be sealed using the same sealing method, e.g., thermal bonding (or thermal fusion) as for the circumference portion to form a sealing portion 111.

3. Forming a Border Line

A border line 30 may be formed by joining (thermal bonding) sheets on opposite sides of the pouch between the body portion 10 and the transparent window portion 20. In this state, the body portion 10 and the transparent window portion 20 may be separated from each other by means of the border line 30. Hence, it is noted that a large amount of the nail gel may be charged in the body portion 10 and a small amount of the nail gel is filled in the transparent window portion 20.

When joining the border line 30, a bonding work may be possible even if there remains a small amount of the nail gel between opposite sides of the pouch, such that the nail gel in the body portion 10 and the transparent window portion 20 may not mix with each other.

Figure 9:
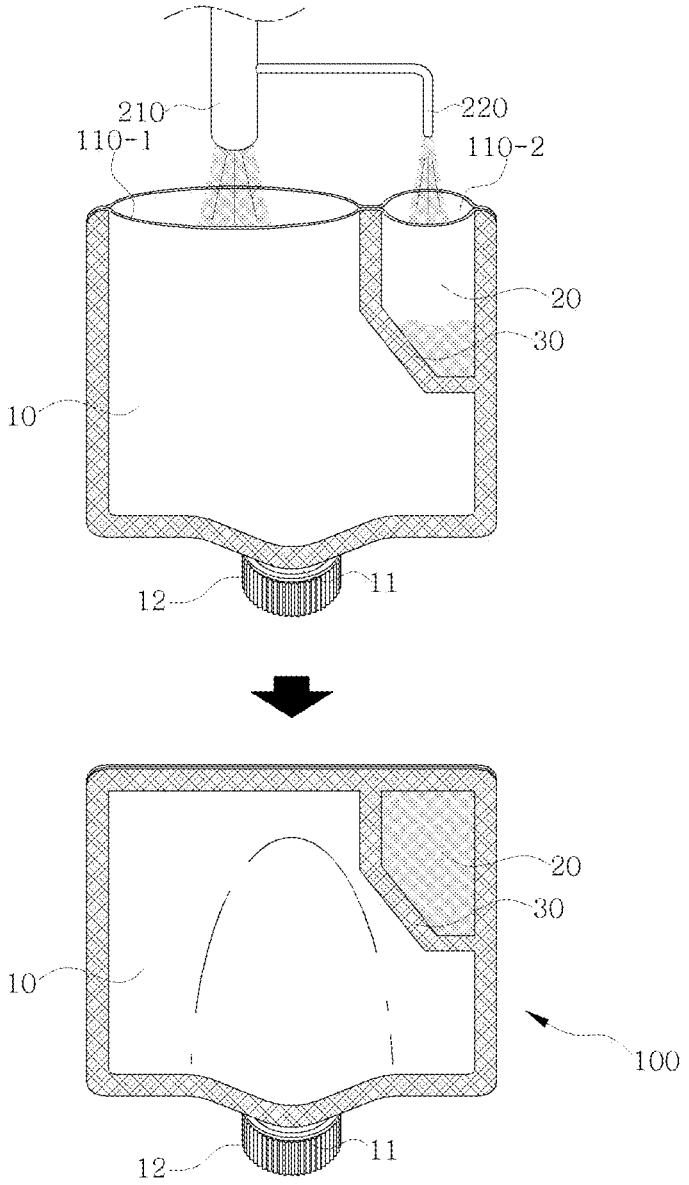
FIG. 9 is an exemplary view illustrating a method of manufacturing an ultraviolet-curable nail gel packaging pouch according to an exemplary embodiment of the present disclosure, wherein after dividing a body portion and a transparent window portion, a nail gel is injected into the body portion and the transparent window portion, respectively.

Second Embodiment (See FIG. 9)

1. Making a Pouch

A pouch 100 according to this embodiment of the disclosure may be formed with two opening portions 110-1 and 110-2. The first opening portion 110-1 may be an opening which communicates with a body portion 10, and the second opening portion 110-2 may be an opening that communicates with a transparent window portion 20. Therefore, the body portion 10 and the transparent window portion 20 may be separated from each other through the border line 30, while only the respective opening portions 110-1 and 110-2 are in open states.

2. Injecting a Nail Gel

A nozzle 200 includes first and second nozzle parts 210 and 220 each injects a nail gel through the first and second opening portions 110-1 and 110-2, respectively. Here, since the amount of the nail gel injected into the transparent window portion 20 is less than the amount of the nail gel injected into the body portion 10, a diameter of the second nozzle part 220 for injecting the nail gel into the transparent window portion 20 may be smaller than a diameter of the first nozzle part 210 for injecting the nail gel into the body portion 10.

The nail gel may be then injected into the body portion 10 and the transparent window portion 20 using the first and second nozzle parts 210 and 220, respectively.

3. Sealing

The first and second opening portions 110-1 and 110-2 which are formed in the body portion 10 and the transparent window portion 20, respectively, are sealed by thermal bonding.

Third and fourth embodiments illustrated below describe a manufacturing process of the pouch using a means for injecting a nail gel (e.g., a spout or the like), wherein a size of the spout may be set to allow injection of the nail gel through a nozzle, that is, into which the nozzle may penetrate.

Figure 10:
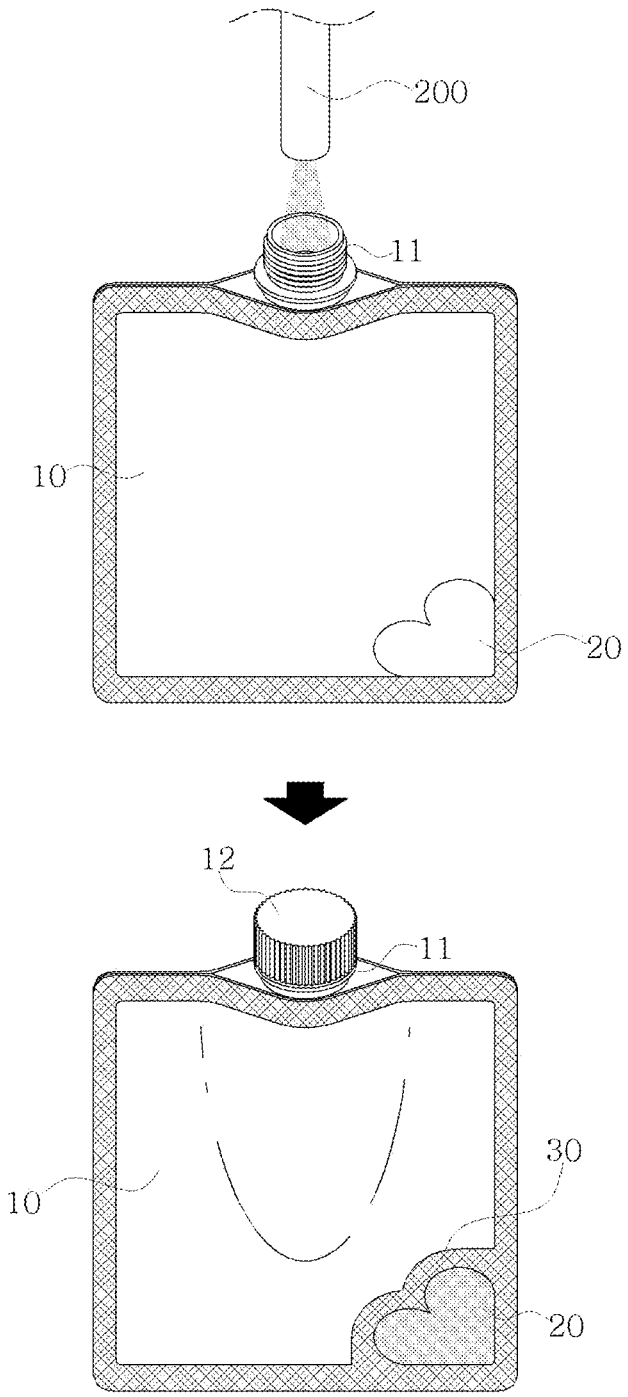
FIG. 10 is an exemplary view illustrating a method of manufacturing an ultraviolet-curable nail gel packaging pouch according to an exemplary embodiment of the present disclosure, wherein after a nail gel is injected through a spout, a body portion and a transparent window portion is divided and sealed to each other.

Third Embodiment (See FIG. 10)

1. Making a Pouch

A pouch according to this embodiment of the disclosure may be made by sealing circumference portions of two pieces of pouch sheets disposed at front and rear sides and by coupling a spout 11 at one side thereof. Here, a body portion 10 and a transparent window portion 20 are not divided or separated from each other.

2. Injecting a Nail Gel

A nozzle 200 may be inserted into the spout 11 and the nail gel is then injected into a space of the pouch through the nozzle 200.

3. Forming a Border Line

A border line 30 may be formed by joining (thermal bonding) two pieces of pouch sheets between the body portion 10 and the transparent window portion 20. In this case, the body portion 10 and the transparent window portion 20 may be discrete in a separate state from each other by means of the border line 30. Hence, it is noted that a large amount of the nail gel may be charged in the body portion 10 and a small amount of the nail gel is partially filled in the transparent window portion 20.

When joining the border line 30, a bonding work may be possible even if there remain some nail gels between two pieces of the pouch sheets, such that the nail gel in the body portion 10 and the nail gel in the transparent window portion 20 may not mix with each other.

Figure 11:
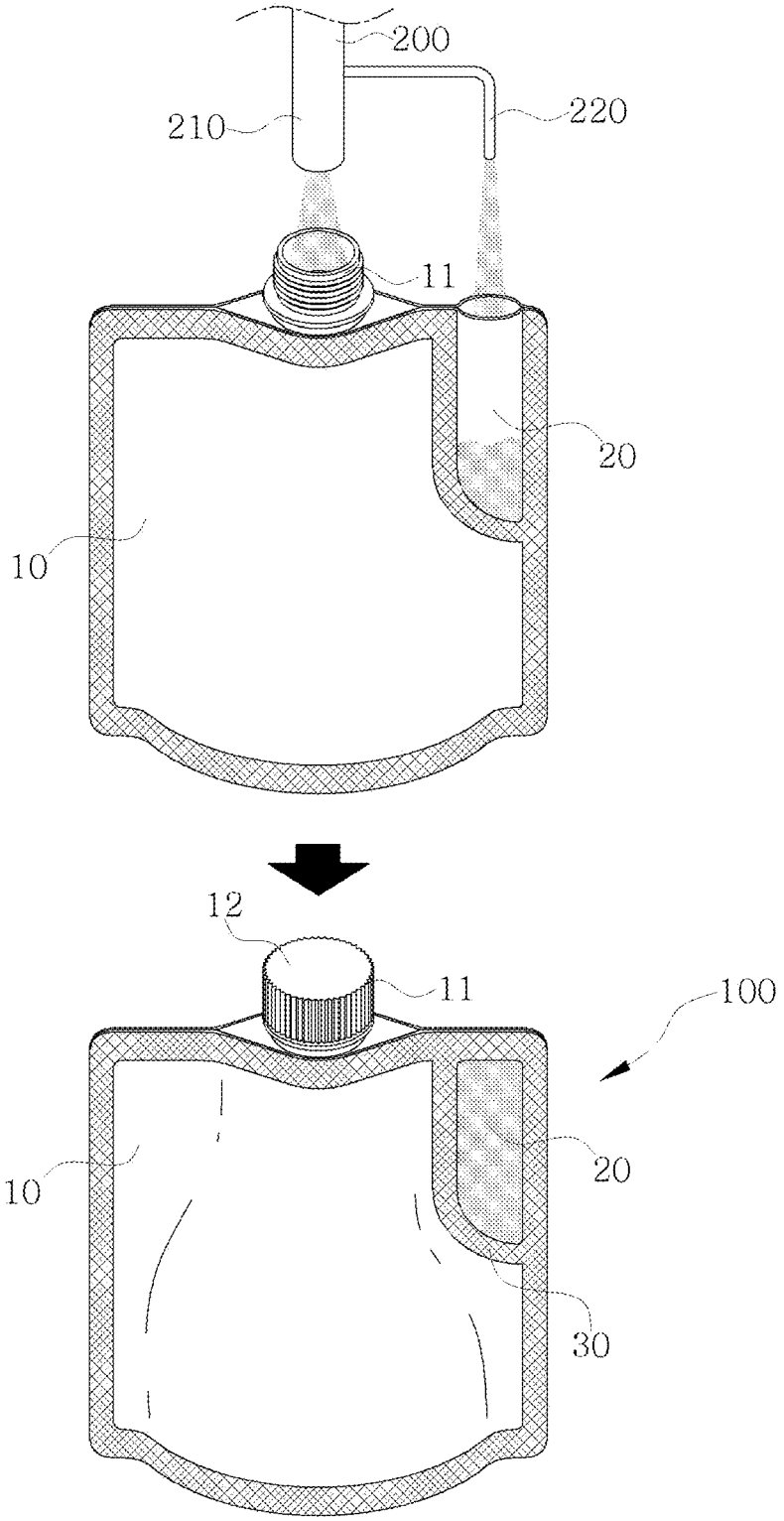
FIG. 11 is an exemplary view illustrating a method of manufacturing an ultraviolet-curable nail gel packaging pouch according to an exemplary embodiment of the present disclosure, wherein after dividing a body portion and a transparent window portion, a nail gel is injected through a spout and an opening portion of the transparent window portion, respectively.

Fourth Embodiment (See FIG. 11)

1. Making a Pouch

A pouch according to this embodiment of the disclosure may be made by sealing circumference portions of two pieces of pouch sheets disposed at front and rear sides, coupling a spout 11 at one side thereof, forming a border line 30 by joining between a body portion 10 and a transparent window portion 20, and forming an opening portion at one side of the transparent window portion 20. Hence, it is noted that the body portion 10 and the transparent window portion 20 are separated and do not communicate with each other due to the border line 30.

2. Injecting a Nail Gel

Using the nozzle 200 described in the Second Embodiment, a nail gel is injected into the body portion 10 and the transparent window portion 20, respectively. A first nozzle part 210 is inserted into the body portion 10 through the spout 11, while a second nozzle part 220 is inserted into the transparent window portion 20 through an opening portion. In this state, a nail gel is injected into the body portion 10 and the transparent window portion 20, respectively.

3. Sealing

A cap 12 may be coupled with the spout 11 and sealed. The opening portion of the transparent window portion 20 may be sealed by thermal bonding.

Hereinafter, a modified example of the present disclosure will be described.

Figure 12:
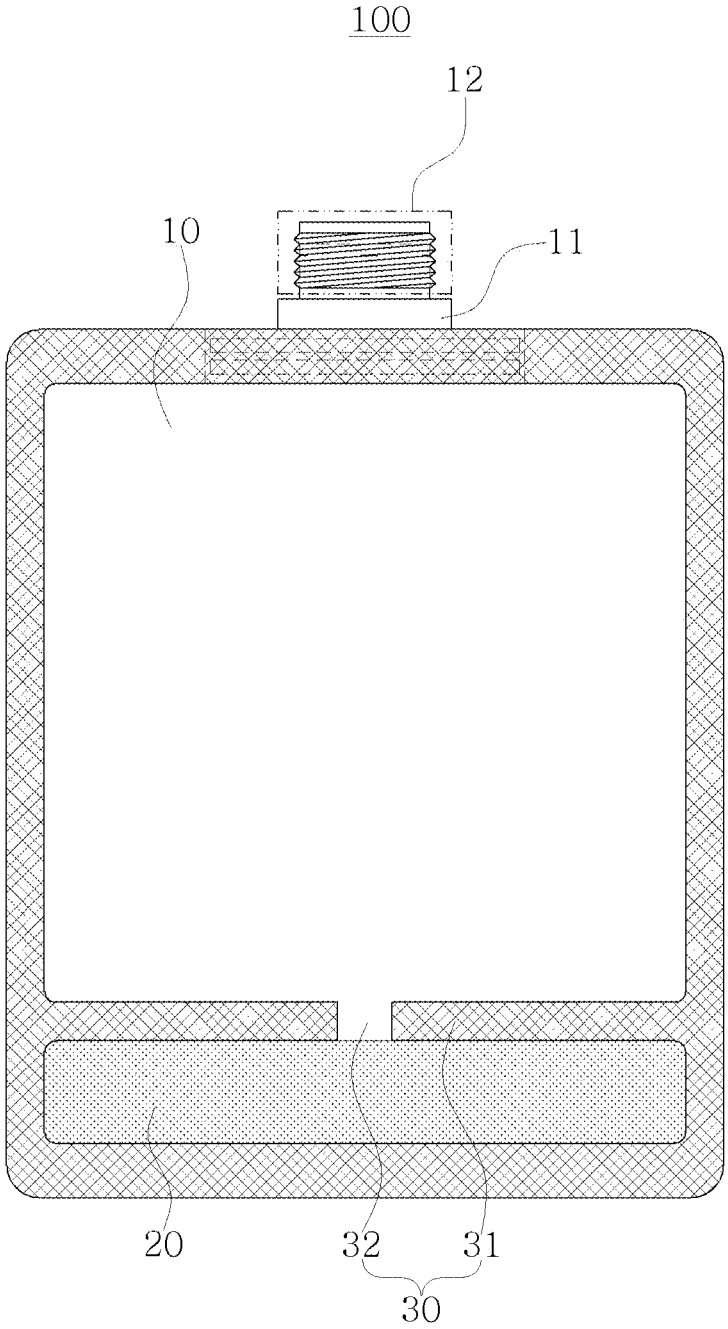
FIGS. 12 to 14 are other exemplary views, respectively, illustrating border line applied to the ultraviolet-curable nail gel packaging pouch according to an exemplary embodiment of the present disclosure.
Figure 13:
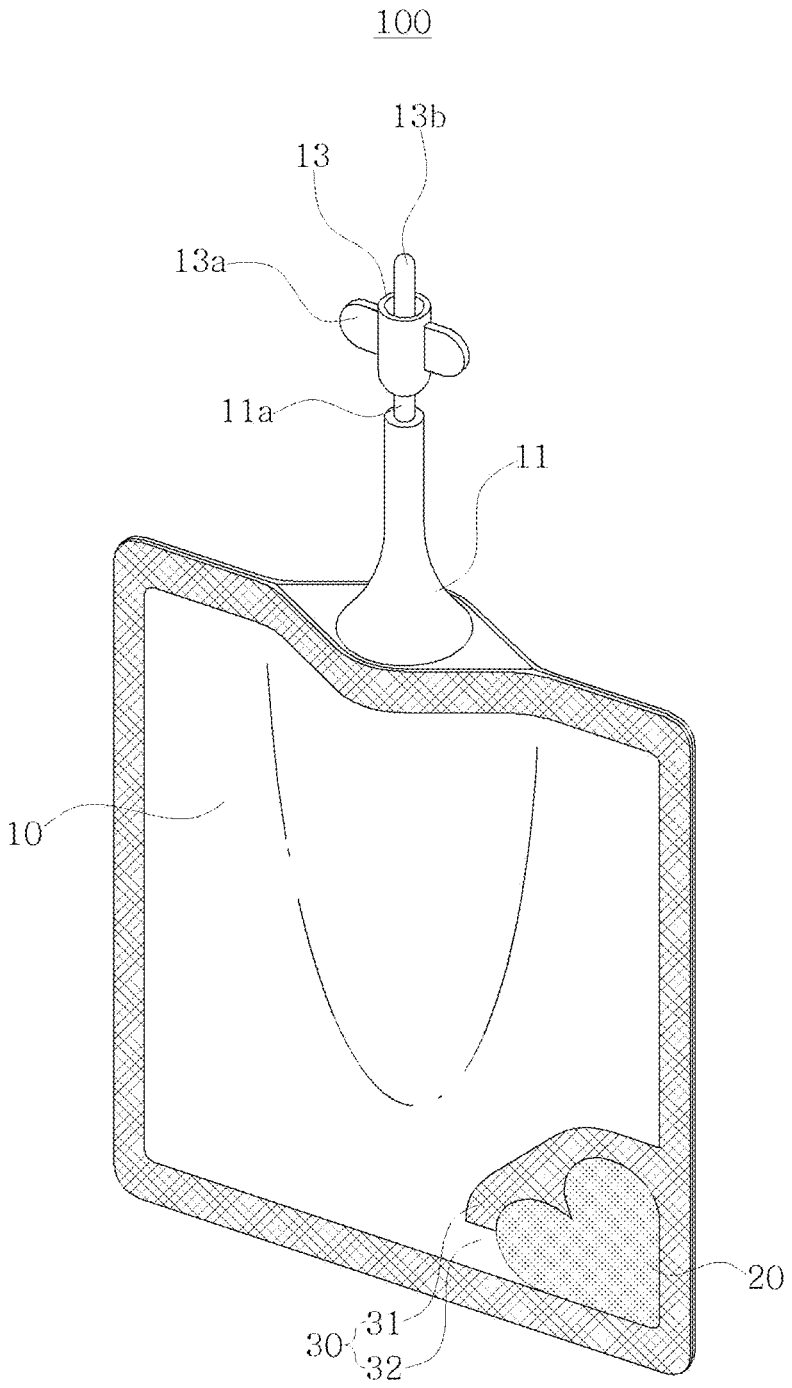
Figure 14:
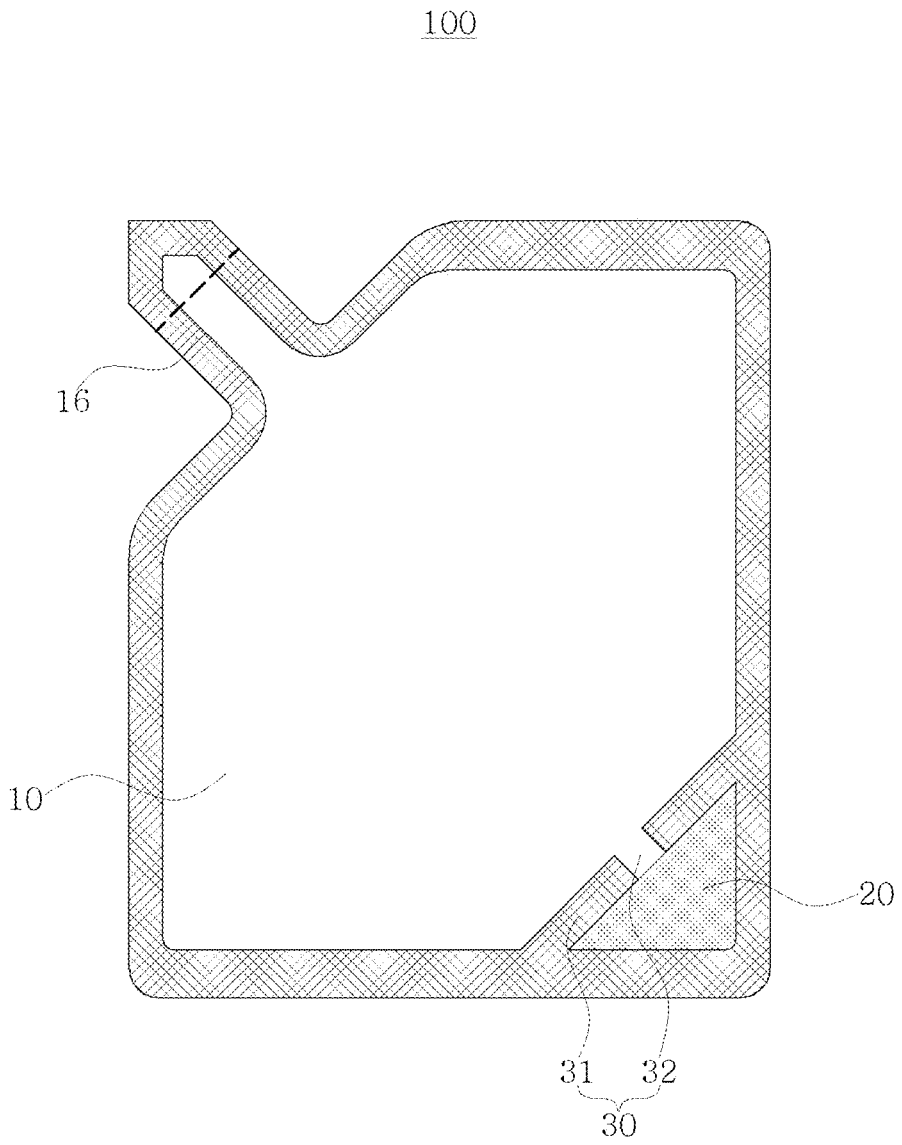

Although, it has been explained that the entire border line 30 separates the body portion 10 and the transparent window portion 20, as shown in FIGS. 12 to 14, the present disclosure may also allow the border line 30 to be composed of a combination of a blocking portion 31 and a connecting portion 32.

The blocking portion 31 prevents the nail gel in the body portion 10 from flowing into the transparent window portion 20, while the connecting portion 32 is a passage that allows a small amount of nail gel from the body portion 10 to flow into the transparent window portion 20.

According to the configuration of the connecting portion 32, the pouch may be formed by sealing the blocking portion 31 of the border line 30 at the time of sealing the circumference portion of the pouch sheet, simplifying the manufacturing process by allowing the nail gel to be injected into the transparent window portion 20 through the connecting portion 32, even in a single injection process. By exposing the transparent window portion 20 of the gel pouch 100 manufactured as above under ultraviolet light, the small amount of nail gel in the transparent window portion 20 is immediately cured, preventing it from flowing back into the body portion 10 and causing no effect to the body portion 10.

Figure 15:
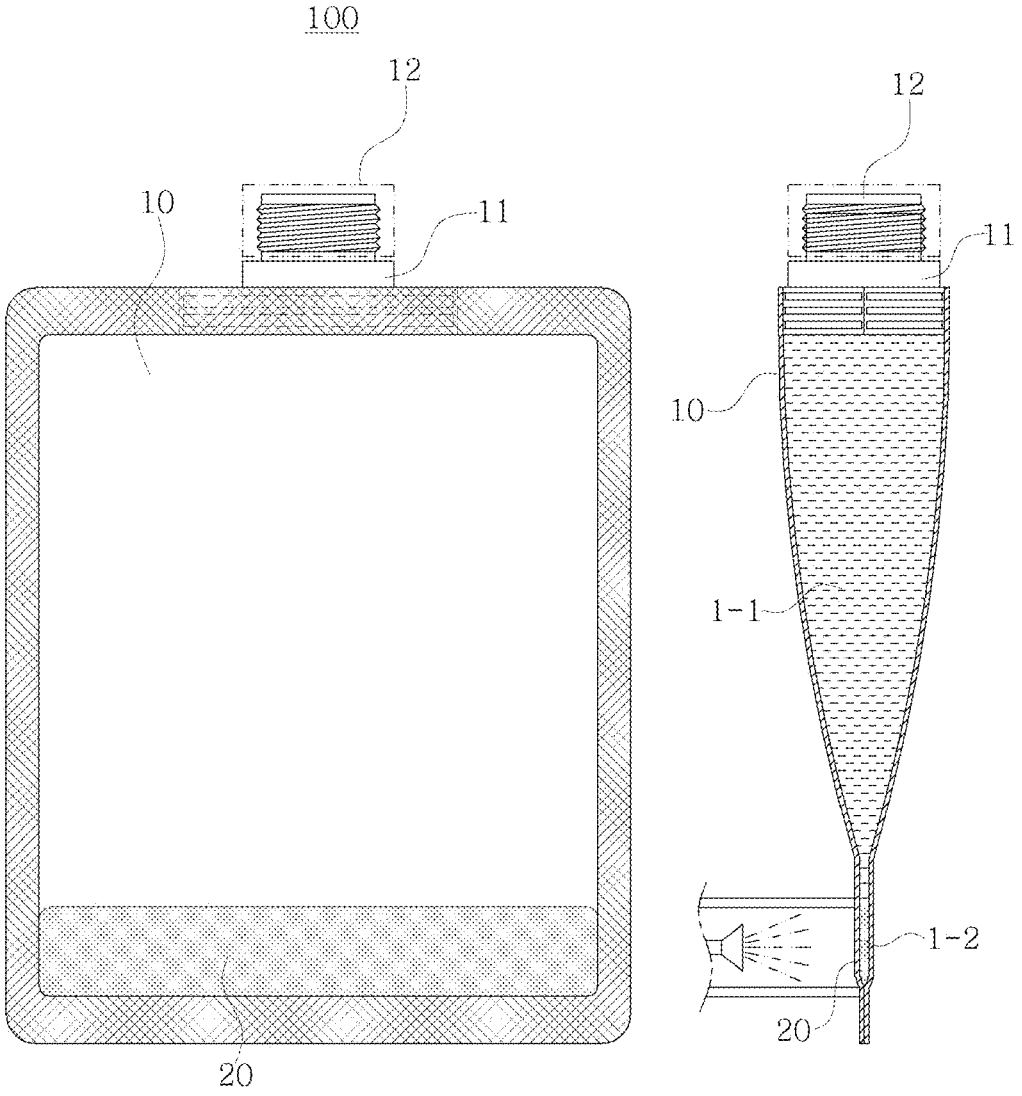
FIG. 15 is another exemplary view illustrating an ultraviolet-curable nail gel packaging pouch according to an exemplary embodiment of the present disclosure.

As shown in the figures, the connecting portion 32, which may be formed in one or more locations along the border line 30, is not limited to being formed at the ends of the border line, but may also be implemented in the middle or at both ends of the border line 30. Additionally, as shown in FIG. 15, the present disclosure may also allow nail gel 1-1 in the body portion 10 and nail gel 1-2 in the transparent window portion 20 to be separated by curing only the nail gel exposed under ultraviolet light, by exposing the transparent window portion 20 under ultraviolet light, without forming a separate border line 30.

To explain this manufacturing method, the pouch has a single internal space without a distinction between the body portion 10 and the transparent window portion 20. When nail gel is injected into the pouch, the gel fills from the bottom of the transparent window portion 20 and is stored in the body portion 10.

Subsequently, when the transparent window portion 20 is pressed to a flattened state and exposed under ultraviolet light, the ultraviolet light passes through the transparent window portion 20 and cures the nail gel inside the transparent window portion 20. The cured nail gel 1-2 in the transparent window portion 20 does not mix with the liquid nail gel 1-1 in the body portion 10 and displays its color externally. Although there is no separate border line, the nail gel is divided into the liquid nail gel 1-1 in the body portion 10, which is used by the user, and the nail gel 1-2, which is exposed externally through the transparent window portion 20 to display the nail gel 1-1 in the body portion 10.

Specific methods for exposing the transparent window portion 20 under ultraviolet light may include, for example, using a jig that matches the outer edge of the transparent window portion 20 to press the outer edge and expose under ultraviolet light through the hollow portion of the jig, pressing only the part of the transparent window portion 20 that connects to the body portion 10 on one side and exposing under ultraviolet light, or pressing the transparent window portion 20 with a transparent plate that allows ultraviolet light to pass through while exposing under ultraviolet light, etc.

Furthermore, a pouch sheet of the present disclosure may be flexible, but it is also possible to use a sheet that may maintain a three-dimensional convex shape when the nail gel is not injected inside, and a sheet may be formed (processed to create a convex shape) as well.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The term "and/or" may include a combination of a plurality of related listed items or any of a plurality of related listed items. For example, "A and/or B" includes all three cases such as "A", "B", and "A and B".

In the present specification, unless stated otherwise, a singular expression includes a plural expression unless the context clearly indicates otherwise.

In exemplary embodiments of the present disclosure, "at least one of A and B" may refer to "at least one of A or B" or "at least one of combinations of at least one of A and B". Furthermore, "one or more of A and B" may refer to "one or more of A or B" or "one or more of combinations of one or more of A and B".

In the exemplary embodiment of the present disclosure, it should be understood that a term such as "include" or "have" is directed to designate that the features, numbers, steps, operations, elements, parts, or combinations thereof described in the specification are present, and does not preclude the possibility of addition or presence of one or more other features, numbers, steps, operations, elements, parts, or combinations thereof.

The foregoing descriptions of specific exemplary embodiments of the present disclosure have been presented for purposes of illustration and description. They are not intended to be exhaustive or to limit the present disclosure to the precise forms disclosed, and obviously many modifications and variations are possible in light of the above teachings. The exemplary embodiments were chosen and described in order to explain certain principles of the disclosure and their practical application, to enable others skilled in the art to make and utilize various exemplary embodiments of the present disclosure, as well as various alternatives and modifications thereof. It is intended that the scope of the present disclosure be defined by the Claims appended hereto and their equivalents.

What is claimed is:

1. An ultraviolet-curable nail gel packaging pouch, the pouch comprising:

a body portion filled with an ultraviolet-curable nail gel and configured to discharge the nail gel therefrom or to be inserted with a brush, wherein the body portion is consisting of pouch sheets configured to prevent ultraviolet light from passing through; and a transparent window portion filled with the nail gel as that of the body portion, wherein the transparent window portion is configured to allow the nail gel as that of the body portion to be visible from an outside, wherein a border line is formed by dividing the body portion and the transparent window portion and is configured to prevent the nail gel filled in the body portion and the transparent window portion from mixing with each other.

2. The pouch of claim 1, wherein the transparent window portion is formed at an inner side adjacent to a circumference portion of the pouch, wherein an inside of the transparent window portion is visible from the outside, so that the nail gel stored therein is directly visible from the outside, and wherein the border line is formed by joining two pieces of pouch sheets disposed at front and rear sides, respectively.

3. The pouch of claim 1, further comprising an opening lid to use the nail gel filled in the body portion, wherein the opening lid includes any one of:

a spout coupled with the body portion and the spout is coupled with a cap;

a spout coupled with the body portion and the spout is detachably connected with a cap portion through a separation groove, wherein the cap is formed with a pin portion to be inserted into a hole of the spout;

a spout coupled with the body portion and the spout is coupled with a cap having a brush; and a nozzle portion integrally formed at one side of the body portion and protruded toward outside of the body portion.

4. The pouch of claim 1, wherein the border line is configured to prevent the nail gel stored in the body portion and the transparent window portion from mixing with each other.

5. The pouch of claim 1, wherein the border line comprises:

a blocking portion which separates the body portion and the transparent window portion; and a connecting portion which allows liquid flow between the body portion and the transparent window portion.

6. The pouch of claim 1, wherein the ultraviolet-curable nail gel packaging pouch is manufactured to maintain a convex shape when the nail gel is not injected inside.

7. An ultraviolet-curable nail gel packaging pouch, the pouch comprising:

a body portion filled with an ultraviolet-curable nail gel and configured to discharge the nail gel therefrom or to be inserted with a brush, wherein the body portion is consisting of pouch sheets configured to prevent ultraviolet light from passing through; and a transparent window portion adjacent to inner side of a circumference portion of the body portion, through which the gel nail stored in the body portion is visible from outside, wherein the nail gel injected into the transparent window portion, from the nail gel injected into the body portion and the transparent window portion, is cured by exposing under ultraviolet light, thereby preventing mixing with the nail gel inside the body portion.

8. A method of manufacturing an ultraviolet-curable nail gel packaging pouch according to claim 1, the method comprising steps of:

forming the pouch including the body portion and the transparent window portion with a single internal space and an opening portion at one side thereof;

injecting the nail gel into the pouch through the opening portion of the pouch;

sealing the opening portion of the pouch; and forming the border line between the body portion and the transparent window portion, wherein the nail gel injected into the pouch is divided and stored separately in the body portion and the transparent window portion to prevent the nail gel filled in the body portion and the transparent window portion from mixing with each other.

9. A method of manufacturing an ultraviolet-curable nail gel packaging pouch according to claim 1, the method comprising steps of:

forming the border line between the body portion and the transparent window portion of the pouch in advance to divide the body portion and the transparent window portion from each other, forming first and second opening portions at one side of the pouch which are open to the body portion and the transparent window portion, respectively;

injecting the nail gel into the body portion and the transparent window portion through the first and second opening portions; and sealing the first and second opening portions to prevent the nail gel filled in the body portion and the transparent window portion from mixing with each other.

10. A method of manufacturing an ultraviolet-curable nail gel packaging pouch according to claim 1, the method comprising steps of:

forming the pouch including the body portion and the transparent window portion with a single internal space and coupled with a spout at one side thereof;

injecting the nail gel into the pouch through the spout of the pouch; and forming the border line between the body portion and the transparent window portion, wherein the nail gel injected into the pouch is divided and stored separately in the body portion and the transparent window portion to prevent the nail gel filled in the body portion and the transparent window portion from mixing with each other.

11. A method of manufacturing an ultraviolet-curable nail gel packaging pouch according to claim 1, the method comprising steps of:

sealing a circumference portion of the pouch;

forming a border line between the body portion and the transparent window portion;

coupling a spout to the body portion;

forming an opening portion in the transparent window portion to allow connection with the outside;

injecting the nail gel into the body portion through the spout while simultaneously injecting the nail gel into the transparent window portion through the opening portion; and sealing the opening portion to prevent mixing of the nail gel contained in the body portion and the transparent window portion.

12. A method of manufacturing an ultraviolet-curable nail gel packaging pouch according to claim 5, the method comprising steps of:

sealing a circumference portion of the pouch and forming a border line between the body portion and the transparent window portion, and coupling a spout to the body portion, wherein the border line is formed with a blocking portion that separates the body portion and the transparent window portion, and a connecting portion that allows liquid flow between the body portion and the transparent window portion; and injecting the nail gel into the body portion through the spout, thereby the nail gel is injected into both the body portion and the transparent window portion through the connecting portion.

13. A method of manufacturing an ultraviolet-curable nail gel packaging pouch according to claim 7, the method comprising steps of:

manufacturing a pouch with a single internal space that includes an opening portion for injecting the nail gel on one side or a spout attached;

injecting the nail gel into the pouch through the opening portion or the spout, then sealing the opening portion or closing cap of the spout; and curing the nail gel inside the transparent window portion of the pouch by exposing under ultraviolet light, thereby preventing the nail gel inside the body portion from mixing with the nail gel inside the transparent window portion.

14. The method of claim 13, wherein the transparent window portion of the pouch containing the nail gel is pressed from the outside to thin the nail gel, and then exposed under ultraviolet light, thereby curing the nail gel inside the transparent window portion.

* * * * *